US011038301B2

(12) United States Patent
Watanabe et al.

(10) Patent No.: US 11,038,301 B2
(45) Date of Patent: Jun. 15, 2021

(54) CONNECTOR ASSEMBLY WITH A PLURALITY OF CIRCUIT BOARDS

(71) Applicant: Tyco Electronics Japan G.K., Kawasaki (JP)

(72) Inventors: Tatsuki Watanabe, Kawasaki (JP); Katsuhiko Kobayashi, Kawasaki (JP)

(73) Assignee: Tyco Electronics Japan G.K., Kawasaki (JP)

( * ) Notice: Subject to any disclaimer, the term of this patent is extended or adjusted under 35 U.S.C. 154(b) by 0 days.

(21) Appl. No.: 16/785,081

(22) Filed: Feb. 7, 2020

(65) Prior Publication Data

US 2020/0259289 A1 Aug. 13, 2020

(30) Foreign Application Priority Data

Nov. 21, 2019 (JP) ..... JP2019-210110

(51) Int. Cl.
*H01R 13/514* (2006.01)
*H01R 12/73* (2011.01)
*H01R 12/72* (2011.01)

(52) U.S. Cl.
CPC ..... *H01R 13/514* (2013.01); *H01R 12/721* (2013.01); *H01R 12/737* (2013.01)

(58) Field of Classification Search
CPC ... H01R 13/514; H01C 12/721; H01C 12/737
See application file for complete search history.

(56) References Cited

U.S. PATENT DOCUMENTS

| | | | | |
|---|---|---|---|---|
| 6,540,522 | B2 * | 4/2003 | Sipe | H01R 13/6658 439/61 |
| 6,666,692 | B2 * | 12/2003 | Billman | H01R 12/716 439/76.1 |
| 9,780,497 | B1 * | 10/2017 | Jeon | H01R 12/91 |
| 10,020,603 | B1 * | 7/2018 | Liu | H01R 12/7023 |
| 10,505,302 | B2 * | 12/2019 | Watanabe | H01R 13/506 |
| 2018/0261942 | A1 * | 9/2018 | Toh | H01R 13/6587 |
| 2019/0165506 | A1 * | 5/2019 | Watanabe | H01R 13/506 |
| 2020/0259289 | A1 * | 8/2020 | Watanabe | H01R 13/518 |

FOREIGN PATENT DOCUMENTS

| | | |
|---|---|---|
| JP | 2007-115582 A | 5/2007 |
| JP | 2007-250396 A | 9/2007 |

OTHER PUBLICATIONS

Abstract of JP2007115582(A), dated May 10, 2007, 1 page.
Abstract of JP2007250396(A), dated Sep. 27, 2007, 1 page.

* cited by examiner

*Primary Examiner* — Abdullah A Riyami
*Assistant Examiner* — Nader J Alhawamdeh
(74) *Attorney, Agent, or Firm* — Barley Snyder

(57) ABSTRACT

A connector assembly includes a plurality of circuit boards and a bracket retaining the plurality of circuit boards. The circuit boards each have a plugging portion to be plugged into a mating connector and each have a first main face facing a second main face of an adjacent circuit board of the plurality of circuit boards. The bracket retains the plurality of circuit boards with the plugging portions facing downward and with each of the circuit boards capable of making a predetermined amount of independent movement in a pair of directions in a horizontal plane.

20 Claims, 8 Drawing Sheets

CONNECTOR ASSEMBLY WITH A PLURALITY OF CIRCUIT BOARDS

CROSS-REFERENCE TO RELATED APPLICATIONS

This application claims the benefit of the filing date under 35 U.S.C. § 119(a)-(d) of Japanese Patent Application No. 2019-20317, filed on Feb. 7, 2019, and Japanese Patent Application No. 2019-210110, filed on Nov. 21, 2019.

FIELD OF THE INVENTION

The present invention relates to a connector assembly and, more particularly, to a connector assembly with a plurality of circuit boards.

BACKGROUND

Some connectors are referred to as a floating type and mate with a mating connector while correcting a misalignment therewith. For example, in Japanese Patent Application No. 2007-115582A, a connector has a housing and a plurality of terminals, each of which has a base portion, a solder tail portion, and a displacement absorbing portion having springiness between the base portion and the solder tail portion. The displacement absorbing portion absorbs a misalignment occurring during mating with the mating connector. In JP 2007-115582A, however, because each terminal has the displacement absorbing portion bulging in a horizontal direction, the connector has an increased size.

SUMMARY

A connector assembly includes a plurality of circuit boards and a bracket retaining the plurality of circuit boards. The circuit boards each have a plugging portion to be plugged into a mating connector and each have a first main face facing a second main face of an adjacent circuit board of the plurality of circuit boards. The bracket retains the plurality of circuit boards with the plugging portions facing downward and with each of the circuit boards capable of making a predetermined amount of independent movement in a pair of directions in a horizontal plane.

BRIEF DESCRIPTION OF THE DRAWINGS

The invention will now be described by way of example with reference to the accompanying Figures, of which.

DETAILED DESCRIPTION OF THE EMBODIMENT(S)

Figure 1:
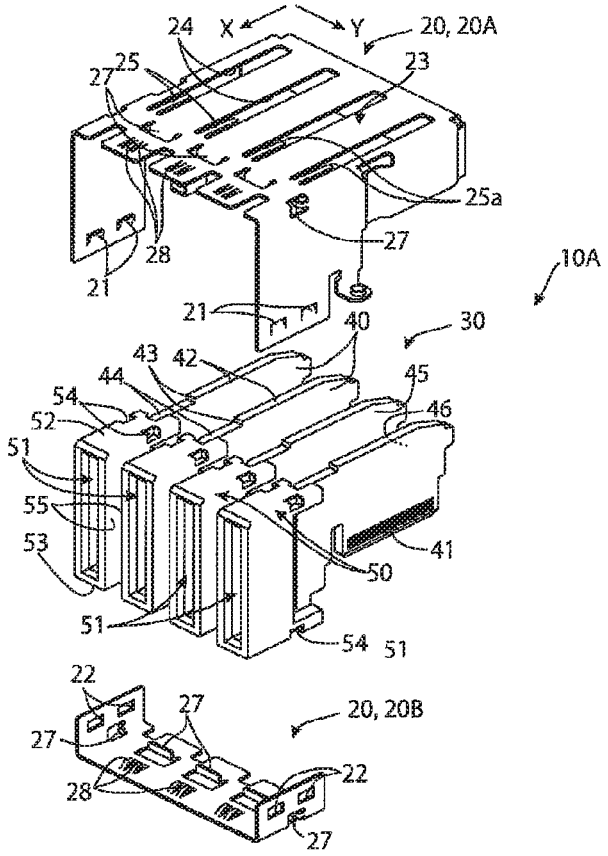
FIG. 1 is an exploded perspective view of a connector assembly according to an embodiment.

Exemplary embodiments of the present disclosure will be described hereinafter in detail with reference to the attached drawings, wherein like reference numerals refer to like elements. The present disclosure may, however, be embodied in many different forms and should not be construed as being limited to the embodiment set forth herein; rather, these embodiments are provided so that the present disclosure will convey the concept of the disclosure to those skilled in the art.

As shown in FIG. 1, a connector assembly 10A according to an embodiment has a bracket 20 and a subassembly 30 accommodated in the bracket 20.

The bracket 20, as shown in FIG. 1, has an upper bracket 20A and a lower bracket 20B formed by cutting and forming a sheet metal. The lower bracket 20B is attached to the upper bracket 20A such that a plurality of individual connectors 50 of the subassembly 30 are held between the upper bracket 20A and the lower bracket 20B from above and below. The lower bracket 20B is assembled with the upper bracket 20A by inserting a lanced tab 21 provided in the upper bracket 20A into a catch hole 22 provided in the lower bracket 20B.

The subassembly 30, as shown in FIG. 1, has a plurality of circuit boards 40 and a plurality of individual connectors 50 connected to the respective circuit boards 40. In the shown embodiment, the subassembly 30 has four circuit boards 40 and four individual connectors 50. The circuit board 40 and the individual connector 50 corresponding to each other are integrated.

Figure 2:
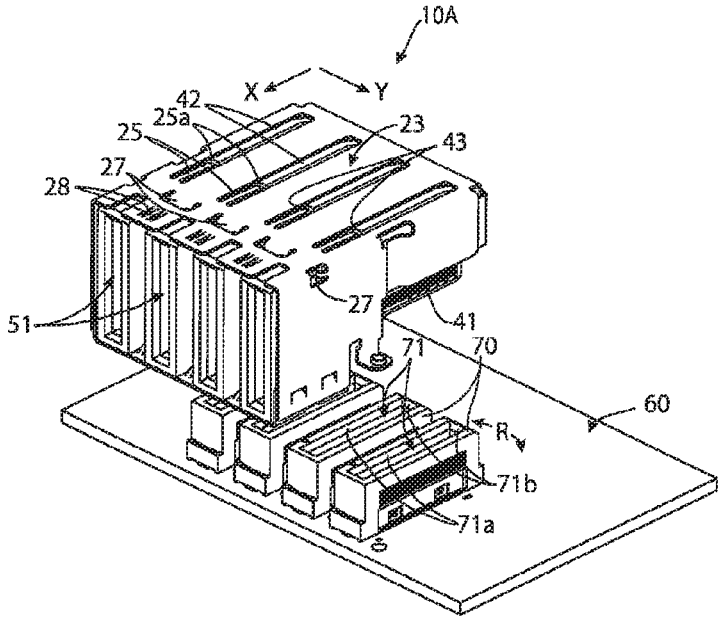
FIG. 2 is a perspective view of the connector assembly and a plurality of mating connectors before mating.

Each of the four circuit boards 40, as shown in FIG. 1, has a plugging portion 41 to be plugged into a mating opening 71 of a mating connector 70 shown in FIG. 2. The plugging portion 41 and the individual connector 50 are electrically connected via printed wiring on the circuit board 40. The circuit boards 40 are arranged in such an attitude as to have a first main face 45 facing a second main face 46 of an adjacent circuit board, and accommodated in the bracket 20. The individual connector 50 is retained by the bracket 20 such that a mating portion 51 faces sideward when the plugging portion 41 faces downward.

As shown in FIGS. 1-3, 4A, and 4B the bracket 20 has an upper plate portion 23 that becomes an upper face of the connector assembly 10A when the plugging portion 41 faces downward. In order to mate the connector assembly 10A and the mating connector 70 with each other, the plugging portion 41 is placed over the mating opening 71 of the mating connector 70 and then the upper plate portion 23 is pressed. Thereby, the plugging portion 41 is plugged into the mating connector 70.

The description will be continued below on the assumption that the circuit board 40 is in such an attitude as to have its plugging portion 41 facing downward, unless otherwise stated. The bracket 20 retains the four circuit boards 40 such that each circuit board 40 can make a predetermined amount of independent movement in both two directions (an X direction and a Y direction) within a horizontal plane.

As shown in FIGS. 1 and 2, in the upper bracket 20A, a slit 24 extending in the X direction that corresponds to each circuit board 40 is formed. Within each slit 24, a cantilever-like butting tab 25 extends rearward from a front in the X direction. The circuit board 40 has a low height portion 44 formed one step lower by a step 43 in a front in the X direction of its upper end face 42. The height of the step 43 corresponds to the wall thickness of the bracket 20.

As shown in FIG. 2, in the connector assembly 10A in an assembled state, a portion behind the step 43 in the X direction of the upper end face 42 of the circuit board 40 is located in the slit 24, and is substantially flush with the upper face portion 23 of the bracket 20. The butting tab 25 extends toward the step 43 over the low height portion 44 of the upper end face 42 of the circuit board 40. A gap is provided between a rear end 25*a* of the butting tab 25 and the step 43, and each circuit board 40 can move in the X direction independently by the amount of this gap. Also, in both right and left (Y direction) sides of an upper face 52 and a lower face 53 of the individual connector 50, a recessed portion 54 is formed as shown in FIG. 1. In the upper bracket 20A and the lower bracket 20B, lanced tabs 27 that move into these recessed portions 54 are formed. The lanced tab 27 gets into the recessed portion 54 having a larger dimension in the X direction than the wall thickness of the lanced tab 27, and thereby a predetermined amount of longitudinal (X direction) movement of the circuit board is allowed, and simultaneously the movement is restricted.

In this manner, regarding the X direction, the butting tab 25, the recessed portion 54, and the lanced tab 27 enable each circuit board 40 to move independently by the predetermined amount. It should be noted that, because the circuit board 40 and the individual connector 50 are integrated in each pair as the subassembly 30, the movement of each pair will be described below as movement of the circuit board 40, and the individual connector 50 will be omitted.

In the case of the connector assembly 10A shown in FIGS. 1 and 2, the longitudinal (X direction) movement is restricted at multiple locations: the butting tab 25 and the recessed portion 54 and the lanced tab 27. The lanced tabs 27 are separated from a wall face facing widthwise (Y direction) of the recessed portion 54 when they are located in the recessed portions 54. Each circuit board 40 is allowed to move widthwise (Y direction) by the amount of this separation.

In the upper bracket 20A and the lower bracket 20B, as shown in FIGS. 1-3, 4A, and 4B, a bulging tab 28 bulging inward is provided. The bulging tabs 28, in the assembled state of the connector assembly 10A, is slightly separated from a side face 55 of the individual connector 50, and arranged in a position facing the side face 55. The circuit board 40 is also enabled by these bulging portions 28 to move widthwise (Y direction) by the amount of this separation.

In the connector assembly 10A, the widthwise (Y direction) movement is restricted at two locations: the lanced tab 27 and the bulging portion 28.

The four circuit boards 40 constituting the connector assembly 10A are retained by the bracket 20 such that they are movable individually independently by the respective predetermined amounts in both the X direction and the Y direction. Also, because each circuit board 40 is movable in both the X direction and the Y direction, an inclination in an X-Y plane (inclination in a rotational directions denoted by an arrow R in FIG. 2) is also allowed.

In FIG. 2, four mating connectors 70 are shown that are soldered on a circuit board 60 and that mate with the connector assembly 10A. These mating connectors 70 are arranged on the circuit board 60 at the same space as the arrangement space of the circuit boards 40 constituting the connector assembly 10A. When these mating connectors 70 are soldered to the circuit board 60, they are sometimes fixed in a position misaligned in the X direction and/or the Y direction from a reference position. When these mating connectors 70 are soldered to the circuit board 60, they are sometimes fixed in an attitude slightly inclined in the direction of the arrow R. The connector assembly 10A is accommodated in the bracket 20 such that each circuit board 40 is provided with a necessary clearance for floating, so as to be capable of mating with the mating connectors 70 even when the mating connector 70 is misaligned and/or inclined.

A process of plugging the plugging portion 41 into the mating opening 71 of the mating connector 70 is shown in FIGS. 5A-5D.

Figures 5A, 5B, 5C, 5D:
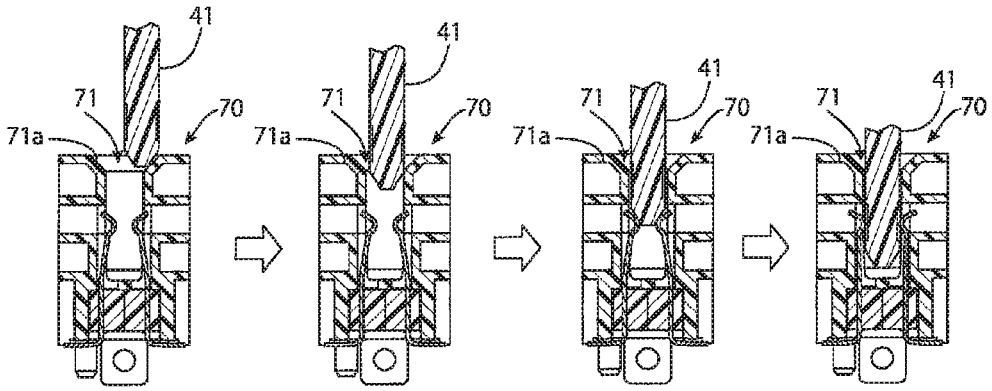
FIG. 5A is a sectional side view of a plugging portion of a circuit board and the mating connector in a first state of mating, taken along line Z-Z of FIG. 3.
FIG. 5B is a sectional side view of the plugging portion and the mating connector in a second state of mating.
FIG. 5C is a sectional side view of the plugging portion and the mating connector in a third state of mating.
FIG. 5D is a sectional side view of the plugging portion and the mating connector in a completely mated state.
Figure 6A:
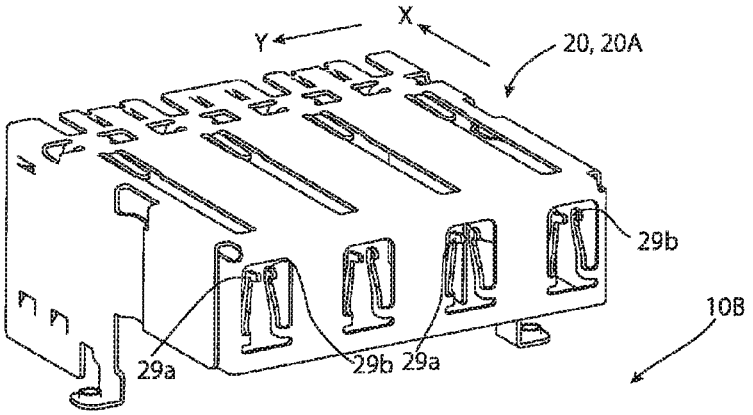
FIG. 6A is a perspective view of an upper bracket of a connector assembly according to another embodiment.
Figure 6B:
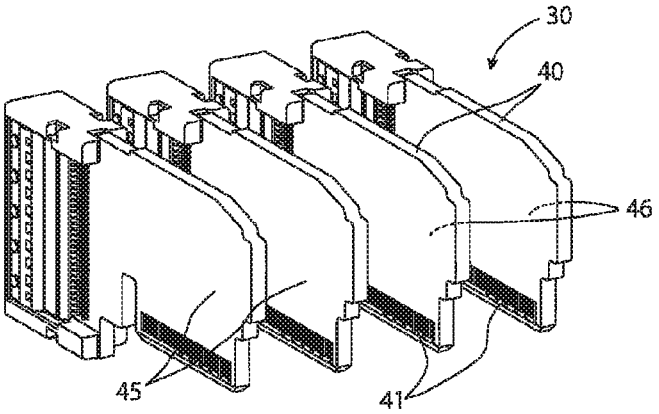
FIG. 6B is a perspective view of a plurality of circuit boards of the connector assembly of FIG. 6A.
Figure 6C:
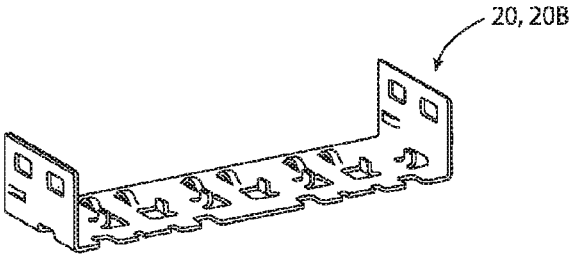
FIG. 6C is a perspective view of a lower bracket of the connector assembly of FIG. 6A.
Figure 7:
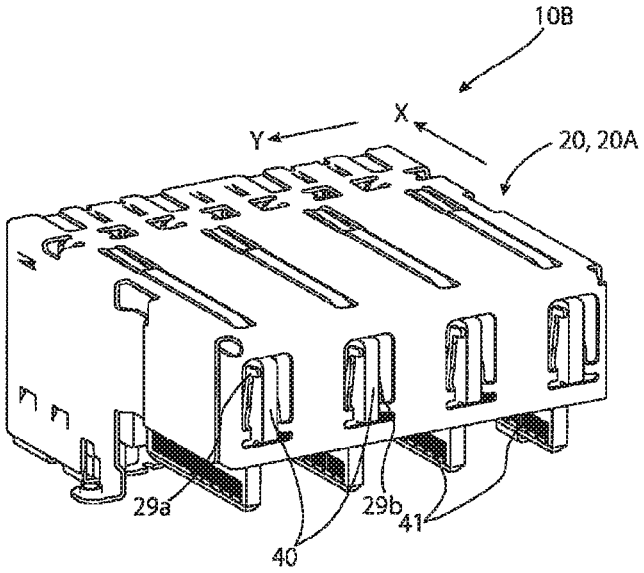
FIG. 7 is a perspective view of the connector assembly of FIG. 6A.
Figure 8:
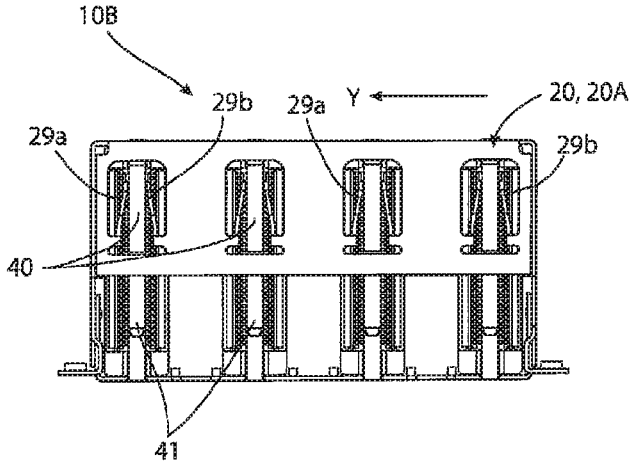
FIG. 8 is a rear view of the connector assembly of FIG. 6A.

In the mating opening 71 of the mating connector 70, a slope 71*a* widening its entrance is formed. In FIG. 5A, the plugging portion 41 is shown approaching the mating opening 71 in a state of being slightly misaligned from the center of the mating opening 71, and being in contact with the slope 71*a*. The circuit board 40 is accommodated in the bracket 20 with a necessary clearance for floating. Here, with the plugging portion 41 left touching the slope 71*a*, the upper face portion 23 of the bracket 20 is pressed down. Thereupon, the plugging portion 41 is correctly plugged into the mating opening 71, as shown in FIGS. 5B and 5C, while the position thereof is being adjusted, and a completely-mated state shown in FIG. 5D is achieved.

In FIGS. 5A-5D, a cross section in the Y direction is shown. In the mating connector 70, a slope 71*b*, shown in FIG. 2, similar to the slope 71*a* shown in FIGS. 5A-5D is formed at both ends in the X direction of the mating opening 71. Thereby, even when there is a misalignment in the X direction, the plugging portion 41 is plugged into the mating opening 71 with the position thereof corrected.

Figure 3:
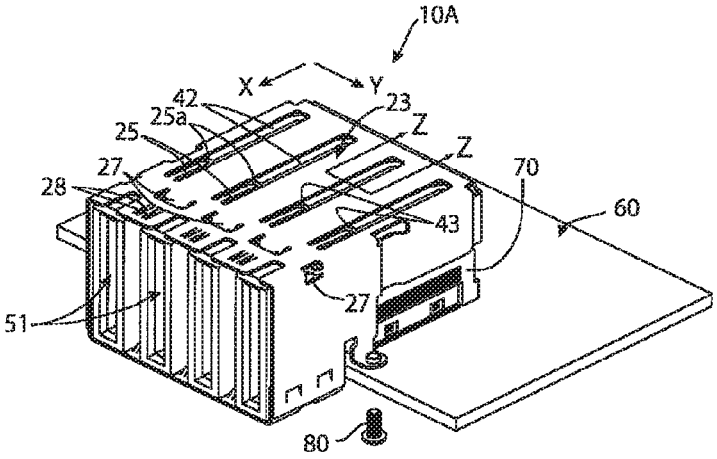
FIG. 3 is a perspective view of the connector assembly and the mating connectors in a mated state.
Figure 4A:
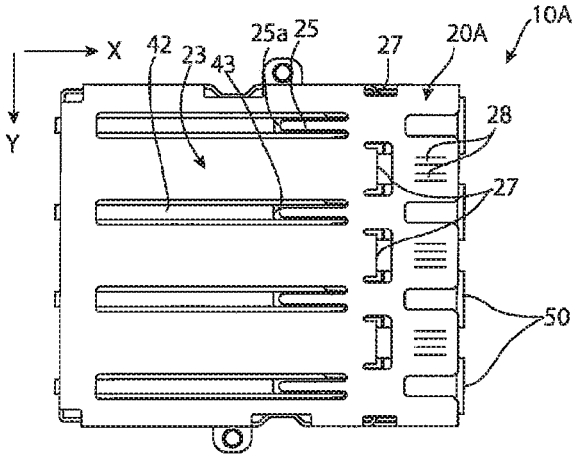
FIG. 4A is a top view of the connector assembly.
Figure 4B:
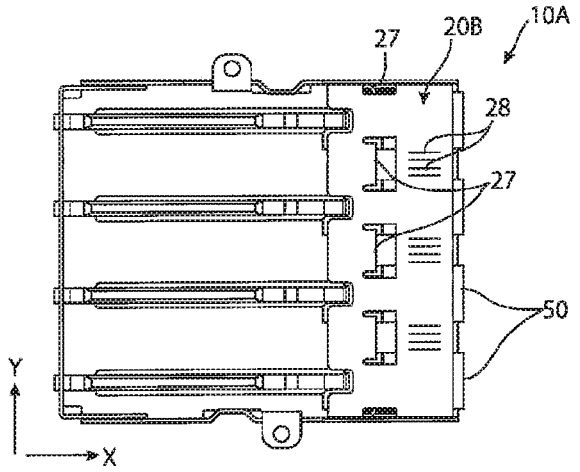
FIG. 4B is a bottom view of the connector assembly.

The connector assembly 10A, in a state of being mated with the mating connectors 70, is screwed to the circuit board 60 at its right and left with two screws 80, one of which is visible in FIG. 3. It should be noted that the misalignment and/or inclination of the mating connector 70 is also reflected on the individual connector 50. However, one connector is individually plugged into each individual connector 50, a slight misalignment or the like of the individual connector 50 does not cause a problem.

According to the connector assembly 10A, even when there is a misalignment or the like of the mating connector 70, the plugging portions 41 of the four circuit boards 40 can be simultaneously easily plugged into the four mating connectors 70. Though the connector assembly 10A having four circuit boards 40 has been described here, the present invention is applicable to a connector assembly 10A having two or more circuit boards.

The connector 50 can include a planar circuit having a conductor insert-molded, or an ordinary printed circuit board.

A connector assembly 10B according to another embodiment is shown in FIGS. 6A-8. Like reference numbers refer to like elements, and only the differences from the connector assembly 10A shown in FIGS. 1-5D will be described in detail herein.

In the upper bracket 20A of a connector assembly 10B, as shown in FIGS. 6A-6C, 7, and 8, a first pressing portion 29*a* and a second pressing portion 29*b* are provided. The first pressing portion 29*a* extends like a cantilever and elastically presses the first main face 45 of the circuit board 40 on a free end side. The second pressing portion 29*b* extends like a cantilever and elastically presses the second main face 46 of the circuit board 40 on a free end side.

The first pressing portion 29*a* and second pressing portion 29*b* press the circuit board 40 in mutually opposite directions and with the same spring force. The circuit board 40 is elastically retained in a substantially central position within backlash in the Y direction in a state of being unmated with the mating connector 70. In the unmated state, jarring is suppressed. Also, because the circuit board 40 is pressed from both sides, jarring in the X direction is also suppressed. At the time of mating to the mating connector 70, if the plugging portion 41 is misaligned with the mating connector 70, the position thereof is corrected, and the plug portion 41 is plugged into the mating opening 71 of the mating connector 70.

The first pressing portion 29*a* and the second pressing portion 29*b* of the connector assembly 10B have a fixed end at a lower portion, and extend upward to form the free end at an upper portion. Accordingly, in order to cover the circuit board 40 with the upper bracket 20A, the circuit board 40 is inserted between the first pressing portion 29*a* and the second pressing portion 29*b* from the fixed end side. That is, the circuit board 40 can be smoothly covered with the upper bracket 20A without being caught on the first pressing portion 29*a* and/or the second pressing portion 29*b*.

What is claimed is:

1. A connector assembly, comprising:

a plurality of circuit boards each having a plugging portion to be plugged into a mating connector and each having a first main face facing a second main face of an adjacent circuit board of the plurality of circuit boards; and a bracket retaining the plurality of circuit boards with the plugging portions facing downward and with each of the circuit boards capable of making a predetermined amount of independent movement in a pair of directions in a horizontal plane, the bracket has a pressing portion elastically pressing the first main face and the second main face of each of the plurality of circuit boards.

2. The connector assembly of claim 1, further comprising a plurality of connectors each connected to one of the circuit boards.

3. The connector assembly of claim 2, wherein each of the connectors is retained by the bracket with a mating portion facing in a direction perpendicular to the plugging portion.

4. The connector assembly of claim 1, wherein the bracket has an upper plate portion forming an upper face of the connector assembly.

5. The connector assembly of claim 4, wherein the upper plate portion is pressed when the plugging portion is plugged into the mating connector.

6. The connector assembly of claim 1, wherein the pressing portion is a spring tab extending like a cantilever.

7. The connector assembly of claim 6, wherein the pressing portion presses the circuit board on a free end side of the pressing portion.

8. The connector assembly of claim 1, wherein the pressing portion has a first pressing portion pressing the first main face facing in a first direction.

9. The connector assembly of claim 8, wherein the pressing portion has a second pressing portion pressing the second main face facing in a second direction opposite to the first direction.

10. The connector assembly of claim 1, wherein the bracket has an upper bracket and a lower bracket attached to the upper bracket.

11. The connector assembly of claim 10, wherein the upper bracket has a plurality of slits and a butting tab extending in each of the slits, each of the slits corresponding to one of the circuit boards.

12. The connector assembly of claim 11, wherein each of the circuit boards has a lower height portion separated in a height direction by a step from an upper end face of the circuit board.

13. The connector assembly of claim 12, wherein a portion of the upper end face of the circuit board behind the step is disposed in the slit and is flush with an upper face portion of the upper bracket.

14. The connector assembly of claim 12, wherein the butting tab extends toward the step over the lower height portion, a gap is disposed in the horizontal plane between a rear end of the butting tab and the step.

15. The connector assembly of claim 2, wherein each of the connectors has a recessed portion receiving a lanced tab of the bracket.

16. The connector assembly of claim 1, wherein the plugging portion is plugged into a mating opening of the mating connector, the mating opening having a slope widening an entrance of the mating opening.

17. A connector assembly, comprising:

a plurality of circuit boards each having a plugging portion to be plugged into a mating connector and each having a first main face facing a second main face of an adjacent circuit board of the plurality of circuit boards; and a bracket retaining the plurality of circuit boards with the plugging portions facing downward and with each of the circuit boards capable of making a predetermined amount of independent movement in a pair of directions in a horizontal plane, the bracket has an upper bracket and a lower bracket attached to the upper bracket, the upper bracket has a plurality of slits and a butting tab extending in each of the slits, each of the slits corresponding to one of the circuit boards.

18. The connector assembly of claim 17, wherein each of the circuit boards has a lower height portion separated in a height direction by a step from an upper end face of the circuit board.

19. The connector assembly of claim 18, wherein a portion of the upper end face of the circuit board behind the step is disposed in the slit and is flush with an upper face portion of the upper bracket.

20. The connector assembly of claim 18, wherein the butting tab extends toward the step over the lower height portion, a gap is disposed in the horizontal plane between a rear end of the butting tab and the step.

* * * * *